US008653419B2

(12) United States Patent
Weiss

(10) Patent No.: US 8,653,419 B2
(45) Date of Patent: Feb. 18, 2014

(54) WINDOW DEFROSTER ASSEMBLY HAVING TRANSPARENT CONDUCTIVE LAYER

(75) Inventor: Keith D. Weiss, Fenton, MI (US)

(73) Assignee: Exatec LLC, Wixom, MI (US)

( * ) Notice: Subject to any disclaimer, the term of this patent is extended or adjusted under 35 U.S.C. 154(b) by 1706 days.

(21) Appl. No.: 11/320,099

(22) Filed: Dec. 28, 2005

(65) Prior Publication Data

US 2006/0096967 A1 May 11, 2006

Related U.S. Application Data

(63) Continuation-in-part of application No. 10/847,250, filed on May 17, 2004.

(51) Int. Cl.

| | |
|---|---|
| ***B60L 1/02*** | (2006.01) |
| ***H05B 1/00*** | (2006.01) |
| ***H05B 3/00*** | (2006.01) |
| ***H05B 11/00*** | (2006.01) |
| ***H05B 3/06*** | (2006.01) |
| ***H05B 3/02*** | (2006.01) |
| ***H05B 3/16*** | (2006.01) |

(52) U.S. Cl.
USPC ..... 219/203; 219/202; 219/219; 219/522; 219/539; 219/543

(58) Field of Classification Search
USPC ..... 219/203, 202, 219, 522, 539, 543
See application file for complete search history.

(56) References Cited

U.S. PATENT DOCUMENTS

| | | | | |
|---|---|---|---|---|
| 2,761,945 | A * | 9/1956 | Colbert et al. | 219/536 |
| 2,932,710 | A * | 4/1960 | Coale et al. | 219/547 |
| 3,020,376 | A | 2/1962 | Hofmann et al. | |
| 3,287,684 | A | 11/1966 | Armbruster, Jr. | |
| 3,409,759 | A * | 11/1968 | Livingston et al. | 219/522 |
| 3,636,311 | A | 1/1972 | Steger | |
| 3,789,192 | A * | 1/1974 | Spindler | 219/522 |
| 3,900,634 | A | 8/1975 | Plumat et al. | |
| 3,947,618 | A | 3/1976 | Gruss | |
| 4,078,107 | A * | 3/1978 | Bitterice et al. | 428/38 |
| 4,102,722 | A | 7/1978 | Shoop | |
| 4,543,466 | A * | 9/1985 | Ramus | 219/203 |
| 4,755,659 | A * | 7/1988 | Leon et al. | 219/547 |
| 4,883,940 | A | 11/1989 | Tokarz | |

(Continued)

FOREIGN PATENT DOCUMENTS

| | | | |
|---|---|---|---|
| EP | 1577133 | A2 | 9/2005 |
| GB | 2 042 859 | A | 9/1980 |

(Continued)

OTHER PUBLICATIONS

Artur Bechtloff, Future of Heatable Automotive Glazing Conductive Pastes, Jun. 18, 2001.

(Continued)

*Primary Examiner* — Henry Yuen
*Assistant Examiner* — Eric Stapleton
(74) *Attorney, Agent, or Firm* — Cantor Colburn LLP

(57) ABSTRACT

A window defroster assembly having a transparent panel and a defroster. The defroster includes a conductive layer applied over the panel and an electrically conductive heater grid formed integrally with the transparent panel. The heater grid includes a series of grid lines and at least a portion of the conductive layer is located between adjacent ones of the grid lines.

25 Claims, 4 Drawing Sheets

(56) References Cited

U.S. PATENT DOCUMENTS

| | | | | | |
|---|---|---|---|---|---|
| 4,894,513 | A | * | 1/1990 | Koontz | 219/203 |
| 4,910,380 | A | * | 3/1990 | Reiss et al. | 219/203 |
| 4,920,254 | A | * | 4/1990 | DeCamp et al. | 219/547 |
| 5,005,020 | A | * | 4/1991 | Ogawa et al. | 343/713 |
| 5,354,966 | A | | 10/1994 | Sperbeck | |
| 5,493,102 | A | | 2/1996 | Takase et al. | |
| 5,525,401 | A | | 6/1996 | Hirmer | |
| 5,750,267 | A | * | 5/1998 | Takase et al. | 428/469 |
| 5,756,192 | A | * | 5/1998 | Crawley et al. | 428/216 |
| 5,766,739 | A | * | 6/1998 | Funaki et al. | 428/201 |
| 5,830,397 | A | | 11/1998 | Hirmer | |
| 6,011,244 | A | | 1/2000 | Castle et al. | |
| 6,024,904 | A | | 2/2000 | Nanri | |
| 6,027,075 | A | | 2/2000 | Petrenko | |
| 6,051,820 | A | * | 4/2000 | Poix et al. | 219/522 |
| 6,103,988 | A | | 8/2000 | Kim | |
| 6,137,086 | A | * | 10/2000 | Williams, Jr. | 219/203 |
| 6,204,480 | B1 | * | 3/2001 | Woodard et al. | 219/203 |
| 6,255,624 | B1 | * | 7/2001 | Boaz et al. | 219/219 |
| 6,870,134 | B2 | * | 3/2005 | Sol et al. | 219/203 |
| 2003/0024726 | A1 | | 2/2003 | Petrenko | |
| 2003/0102465 | A1 | | 6/2003 | Nagai et al. | |
| 2006/0081581 | A1 | * | 4/2006 | Odeh | 219/203 |

FOREIGN PATENT DOCUMENTS

| | | | |
|---|---|---|---|
| JP | H06171358 | A | 6/1994 |
| JP | H11020622 | A | 1/1999 |
| WO | WO 94/05524 | | 3/1994 |

OTHER PUBLICATIONS

European Patent No. 157713 (A2); Publication Date: Sep. 21, 2005; Abstract Only; 1 Page.

Japanese Patent No. H06171358 (A); Publication Date: Jun. 21, 1994; Abstract Only; 1 Page.

Japanese Patent No. H11020622 (A); Publication Date: Jan. 26, 1999; Abstract Only; 1 Page.

International Search Report; International Application No. PCT/US2006/048444; International Filing Date: Dec. 19, 2006; 2 Pages.

Written Opinion of the International Searching Authority; International Application No. PCT/US2006/048444; International Filing Date: Dec. 19, 2006; 6 Pages.

* cited by examiner

WINDOW DEFROSTER ASSEMBLY HAVING TRANSPARENT CONDUCTIVE LAYER

CROSS REFERENCE TO RELATED APPLICATION

This application is a continuation-in-part of prior application Ser. No. 10/847,250 filed May 17, 2004, the entire contents of which are hereby incorporated by reference.

BACKGROUND

1. Field of the Invention

This invention relates to a conductive heater grid design that provides performance characteristics making it amenable for use in defrosting plastic and glass panels, such as windows in vehicles.

2. Related Technology

Plastic materials, such as polycarbonate (PC) and polymethylmethyacrylate (PMMA), are currently being used in the manufacturing of numerous automotive parts and components, such as B-pillars, headlamps, and sunroofs. Automotive rear window (backlight) systems represent an application for these plastic materials due to their many identified advantages, particularly in the areas of styling/design, weight savings, and safety/security. More specifically, plastic materials offer the automotive manufacturer the ability to reduce the complexity of the rear window assembly through the integration of functional components into the molded plastic system, as well as the ability to distinguish their vehicles by increasing overall design and shape complexity. Being lighter in weight than conventional glass backlight systems, their incorporation into the vehicle may facilitate both a lower center of gravity for the vehicle (and therefore better vehicle handling & safety) and improved fuel economy. Further, enhanced safety is realized, particularly in a roll-over accident because of a greater probability of the occupant or passenger being retained in a vehicle.

Although there are many advantages associated with implementing plastic windows, these windows are not without limitations that represent technical hurdles that must be addressed prior to wide-scale commercial utilization. Limitations relating to material properties include the stability of plastics during prolonged exposure to elevated temperatures and the limited ability of plastics to conduct heat. Regarding the latter, in order to be used as a rear window or backlight on a vehicle, the plastic material must be compatible with the use of a defroster or defogging system. For commercial acceptance, a plastic backlight must meet the performance criteria established for the defrosting or defogging of glass backlights.

The difference in material properties between glass and plastics becomes quite apparent when considering heat conduction. The thermal conductivity of glass ($T_c$=22.39×10$^{-4}$ cal/cm-sec-° C.) is approximately 4-5 times greater than that exhibited by a typical plastic (e.g., $T_c$ for polycarbonate=4.78×10$^{-4}$ cal/cm-sec-° C.). Thus, a defroster or defogger (hereafter just "defroster") designed to work effectively on a glass window may not necessarily be efficient at defrosting or defogging (hereafter just "defrosting" or "defrost") a plastic window. The lower thermal conductivity of the plastic may limit the dissipation of heat from the heater grid lines across the surface of the plastic window. Thus, at a similar power output, a heater grid on a glass window may defrost the entire viewing area, while the same heater grid on a plastic window may only defrost those portions of the viewing area that are close to the grid lines.

A second difference between glass and plastics that must be overcome is related to the electrical conductivity exhibited by a printed heater grid. The thermal stability of glass, as demonstrated by a relatively high softening temperature (e.g., $T_{soften}$>>1000° C.), allows for the sintering of a metallic paste on the surface of the glass window to yield a substantially inorganic frit or metallic wire. Since the softening temperature of glass is significantly greater than the glass transition temperature of a typical plastic resin (e.g., polycarbonate $T_g$=145° C.), a metallic paste cannot be sintered onto a plastic panel. Rather, it must be cured on the panel at a temperature lower than the $T_g$ of the plastic resin.

A metallic paste typically consists of metallic particles dispersed in a polymeric resin that will bond to the surface of the plastic to which it is applied. The curing of the metallic paste provides a conductive polymer matrix having closely spaced metallic particles dispersed throughout a dielectric layer. The presence of the dielectric layer (e.g., polymer) between dispersed conductive particles leads to a reduction in the conductivity, or an increase in resistance, of the cured heater grid lines, as compared to dimensionally similar heater grid lines sintered onto a glass substrate. This difference in conductivity manifests itself in poor defrosting characteristics exhibited by the plastic window, as compared to the glass window.

From the above, it is seen that there is a need in the industry for a system that will effectively defrost a plastic window with performance characteristics similar to that of a conventional glass window.

BRIEF SUMMARY

The present invention provides a heater grid capable of defrosting the viewing area of a window in a manner that emulates the performance of a conventional heater grid on a glass window. The present invention allows the spacing between grid lines to be greater than the conventional spacing of 25-30 mm currently used for heater grids on glass windows. Due to its performance on a plastic panel window, the heater grid of the present invention is anticipated as being usable to increase the grid line spacing for a heater grid applied on a glass panel or window.

Accordingly, in one aspect, the present invention provides a transparent, conductive coating and a conductive heater grid applied over a transparent panel. The conductive heater grid has a group of grid lines with opposing ends connected to first and second bus bars and portions. Accordingly, the conductive coating is located between a pair of adjacent grid lines.

In another aspect, the conductive coating is thermally conductive and, in another aspect it is electrically thermally conductive.

In a further embodiment, the present invention includes a transparent panel with a transparent conductive coating between a pair of bus bars, also applied to the panel.

In another embodiment, the present invention provides a window assembly as described above, with a protective coating. The protective coating may further comprise a plurality of coatings provided in a layered structure to enhance protection against weathering and abrasion.

Other objects and advantages of the present invention will become apparent upon considering the following detailed description and appended claims, and upon reference to the accompanying drawings.

DETAILED DESCRIPTION

Figure 1:
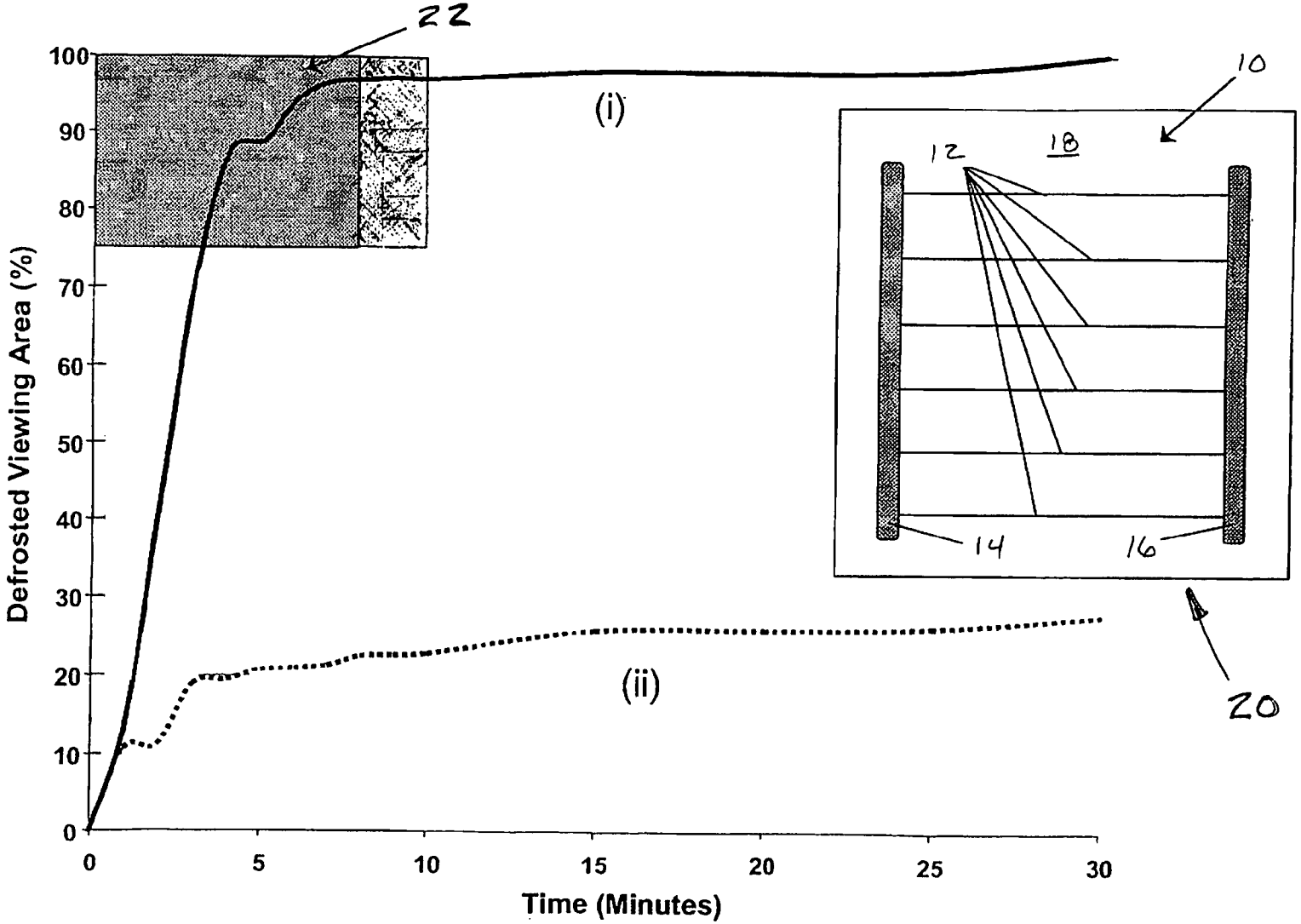
FIG. 1 is a plot of the percentage of the viewing area defrosted as a function of time for a conventional heater grid formed via (i) a silver paste fired on a glass panel, and (ii) a silver ink cured on a plastic panel.

The following description of the preferred embodiment is merely exemplary in nature and is in no way intended to limit the invention or its application or uses.

The inventors have observed that a conventional heater grid or defroster formed on a plastic panel (using a metallic ink and subsequently cured according to the manufacturer's recommendations) performs poorly in industry standardized defroster tests established for the evaluation of a heater grid on a glass window. The test protocol for the automotive industry requires that at least 75% of the visual area be defrosted within a 30 minute time frame. This protocol, however, is considerably slower than the results typically seen for a glass window. In order for a defroster formed on a plastic panel to achieve performance similar to a defroster formed on glass, the heater grid must actually defrost at least 75% of the viewing area in less than about ten minutes. The test protocol utilized to characterize window defrosting is well known to those skilled in the art and is adequately described by Society of Automotive Engineers (SAE) standard J953 (April 93), as well as by many automotive manufacturer internal specifications, such as Volkswagen/Audi specification #TL 820-45 or Ford Motor Company specification #01.11-L-401. An eleven step process very similar to the SAE standard test protocol, proceeds as follows:

a Determine the voltage necessary to equilibrate the temperature of the heater grid at <70° C. under ambient environmental conditions b Soak the panel for >8 hours at a temperature of −18 to −20° C.

c Spray panel while in a horizontal position with 460 mL/m$^2$ of water d Soak panel for >1 hour additional time to freeze the water e Place the panel in a vertical position f Monitor the environmental temperature and air movement (for entire test)

g Turn the defroster ON (use voltage established in step a)

h Record the voltage, current and grid temperature at time zero i Take measurements (see step h) & pictures every 3 minutes and at defrost "break-through" (initial observed melting)

j End test when 100% viewing area is cleared or after 40 minutes k Analyze the time required to clear 75% of the viewing area In the test protocol, the temperature of the grid pattern, throughout the entire test, should not exceed 70° C. under ambient environmental conditions (step a). The window is placed into a cold chamber and allowed to reach thermal equilibrium at −18 to −20° C. (step b). The window is then sprayed while in a flat or horizontal position with 460 milliliters of water for every square meter of surface area in the established viewing area (i.e., area to be defrosted) and allowed to equilibrate at temperature for an additional one hour (steps c and d). The window is then placed into a vertical position (step e) and the temperature in the cold chamber environment, along with the wind velocity, is monitored (step f) periodically throughout the entire test. A wind speed in the cold chamber may be established, generally up to a maximum speed of 440 ft/min, upon the introduction of an air blower module. This speed is preferred for establishing acceptable defroster performance due to the potential wind chill that could be experienced on the surface of a backlight when actually mounted in a moving vehicle.

The defroster is then turned-on by the application of the voltage identified in "step a" to the heater grid (step g). The voltage and current applied to the heater grid, along with the temperature established by the heater grid, is measured at time zero (step h) and through-out the test (step i). Pictures of the viewing area are taken every three minutes and at the initiation of melting or defrost "break-through" (step i). The test is stopped either after 100% of the viewing area is defrosted or after 40 minutes has passed (step j). The amount of viewing area that has been defrosted as a function of time is then quantitatively determined as a percentage of the total viewing area (step k).

A conventional heater grid 10 design is generally shown in FIG. 1. This simple design consisted of six parallel gridlines 12 that are approximately 1 mm wide and 230 mm in length. All grid lines 13, which were spaced 25 mm apart from each other, start and end at either opposing bus bars 14, 16. Each bus bar 14, 16 is about 26 mm in width. Two identical heater grids 10 were constructed, one grid on a glass panel and the other grid on a plastic, more specifically polycarbonate, panel 18. The grid 10 on the glass panel 18 was of a conventional silver frit material, as is used in the automotive industry. This conductive material was screen printed onto the panel 18 and subsequently sintered at 1100° C. for 3.5 minutes, thereby leaving a silver frit material on the surface of the glass. For plastic panel 18, a silver ink containing an organic binder (#11809 2k Silver, Creative Materials, Tyngsboro Mass.) was screen printed onto a polycarbonate substrate (polycarbonate, Makrolon® Al2647, Bayer AG, Leverkusen, Germany) and subsequently cured at 100° C. for 30 minutes. The thickness of the resulting grid lines and bus bars on each of the panels 18 was found through the use of profilometry to be on the order of 10-14 micrometers. The heater grid 10 on the polycarbonate panel was finally subjected to the application of a silicone hard-coat system (SHP401/AS4000, GE Silicones, Waterford, N.Y.) to provide protection against weathering and abrasion. Each of the two resulting defrosters 20 was tested according to the procedure described in Table 1 with the maximum wind speed applied.

The application of 6.24 volts and 14.45 volts respectively, was found necessary to establish a thermal equilibrium that was slightly less than the maximum limit of 70° C. in the heater grids deposited on glass and on polycarbonate, when tested under ambient (23° C.) air temperature. The heater grid 10 on glass was observed to defrost 75% of the viewing area in less than 5 minutes at −20° C. (air temperature), with greater than 95% of the viewing area being defrosted in approximately 10 minutes. This is shown by trace (i) in FIG. 1. The maximum temperature exhibited by this defroster under the test conditions was observed to be 15.5° C.

In comparison, the grid 10 deposited on polycarbonate was observed to defrost slightly more than 20% of the viewing area in 10 minutes at −20° C. (air temperature), with less than 30% of the viewing area being defrosted in 30 minutes (as shown by trace (ii) in FIG. 1). The maximum temperature measurement exhibited by this defroster under the test conditions was found to be −8.0° C.

This example demonstrates that the design of a conventional heater grid 10, as typically used with glass windows, is not acceptable for use with plastic windows, such as polycarbonate. As shown in FIG. 1 the ability of a cured silver ink to defrost a polycarbonate panel is substantially lower than the ability of a sintered silver frit to defrost a glass panel under identical conditions. The performance goal for a defroster formed on a plastic panel, in order to simulate a similar heater grid design formed on glass, is thus established to be at least 75% clearing of the visual area in less than about 10 minutes, as designated by area 22 in, FIG. 1.

As demonstrated above, a conventional heater grid 10 designed for a glass window will not properly function on a plastic window to the same performance. The primary physical differences that impact performance between the glass and plastic window and their associated defroster systems are (1) the lower thermal conductivity ($T_c$) of plastic and (2) the higher electrical conductivity of a silver paste on glass sintered at a high temperature (as compared to a silver paste on plastic cured at a relatively low temperature (i.e., below the glass transition temperature, $T_g$, of the plastic)).

The conventional defroster grid 10 formed on the glass panel 18 exhibited a more uniform surface temperature over its entire surface as compared to a similar defroster grid 10 integrally formed on a plastic panel 18. The thermal distribution across each heater grid line, as well as the space between each grid line was examined using thermal imaging equipment (ThermaCAM® S40, FLIR Systems Inc., Boston, Mass.). The maximum grid line temperature of the grid 10 on glass was found to reach approximately 30° C., while the grid line temperature of the grid 10 on plastic reached approximately 44° C. The difference in grid line temperature and the surface temperature of the glass between each grid line was found to be approximately 2-3° C. The difference in grid line temperature and the surface temperature of the plastic between each grid line, however, was found to be significantly higher, approximately 10-15° C. The small difference in temperature between the grid lines and the glass there between occurs due to the high thermal conductivity associated with glass. Similarly the large difference in temperature between the grid lines and the plastic there between occurs due to the lower thermal conductivity associated with the plastic, in the above example polycarbonate.

The present invention provides a defroster design that allows a plastic panel or window to be defrosted within the conditions described for glass windows under conventional industry standardized test conditions. As such, the defroster design of the present invention is capable of simulating the standard acceptable performance of a heater grid 10 on glass, namely defrosting at least 75% of the viewing area in less than about 30 minutes. Further, the defroster of the present invention, when applied to plastic panels, more closely achieves the actual performance characteristics of existing heater grids on glass, namely defrosting at 75% of the viewing area within 10 minutes. As detailed below, due to its superior performance on a plastic panel or window, the present invention may be used to increase the grid line spacing for a defroster on a glass window, thereby the percentage of visibility through a grid on glass.

Figure 2A:
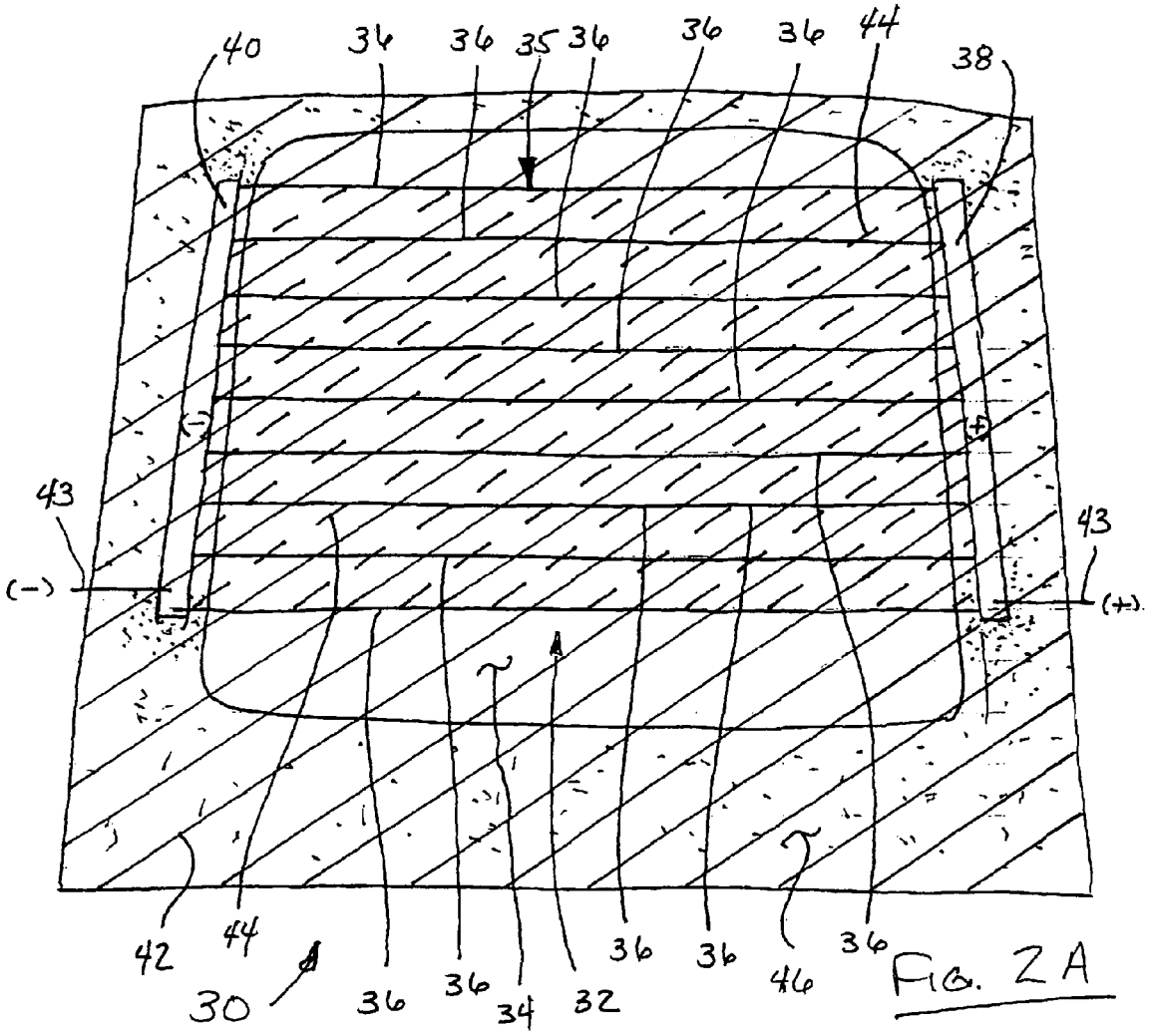
FIGS. 2A and 2B illustrate, respectively, a horizontal-oriented heater grid and a vertically oriented heater grid on a transparent panel in a window module, and embodying the principles of the present invention, as may from the inside of a vehicle.
Figure 2B:
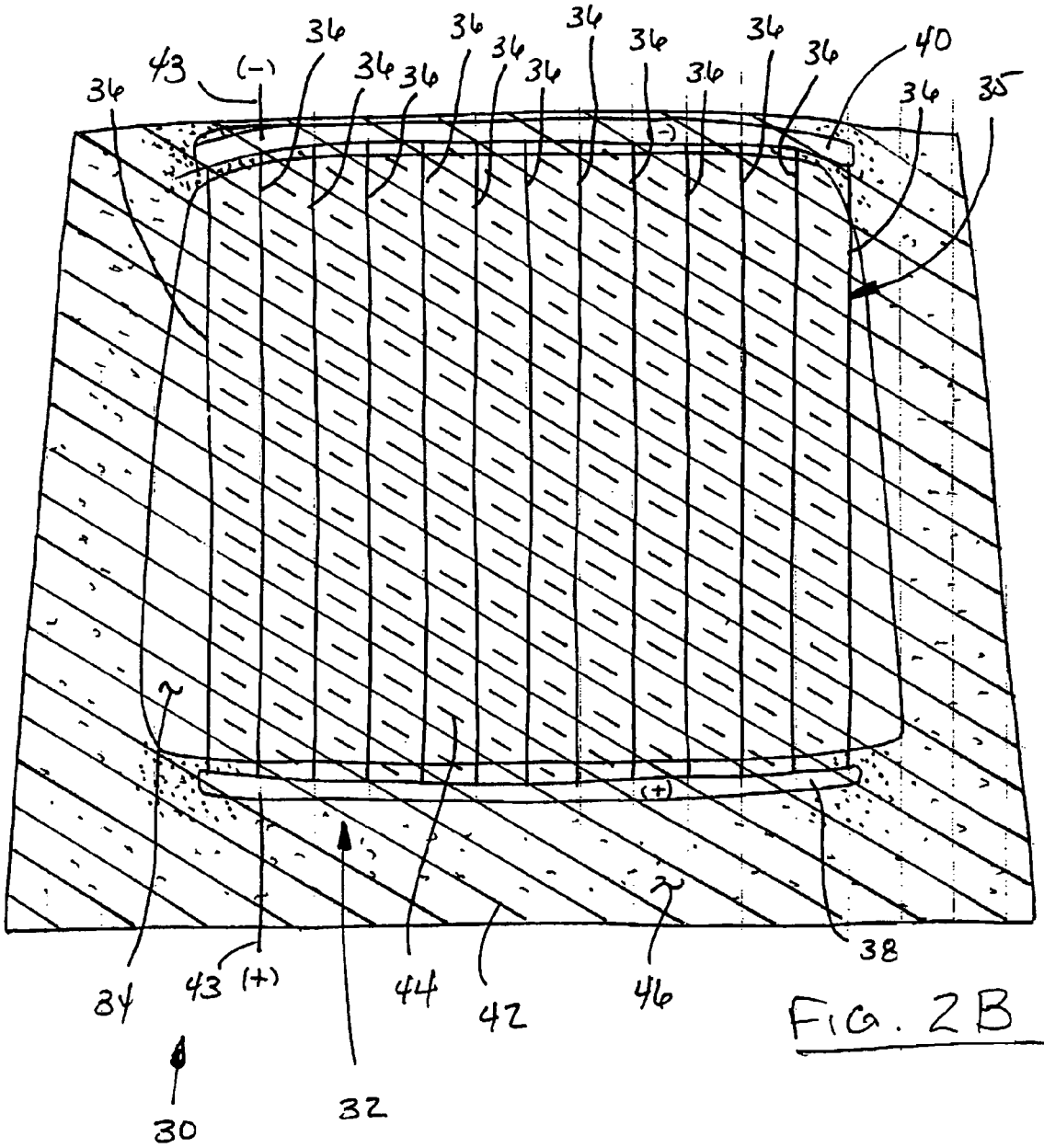

Referring now to FIGS. 2A and 2B, a window defroster assembly embodying the principles of the present invention is generally illustrated therein and designated at 30. FIGS. 2A and 2B respectively illustrated a window defroster assembly 30 with a horizontal heater grid orientation and a vertical heater grid orientation. In all other respects, the constructions are the same, and for that reason, the figures utilize common reference numerals.

The window defroster assembly 30 generally includes a defroster 32 provided on a panel 34. The defroster 32 includes a heater grid 35 having a series of grid lines 36 extending between generally opposed bus bars 38, 40. As further discussed below, the defroster 32 additionally includes a transparent, conductive layer 42 applied over the panel 34.

The bus bars 38, 40 are respectively designated as positive and negative bus bars and each is accordingly coupled in one or more places via leads 43 to the electrical system of the vehicle, thereby establishing an electric circuit. Such an electrical system is typically a 12 volt system.

Upon the application of current to the heater grid 35, the current will flow through the grid lines 36 from the positive bus bar 38 to the negative bus bar 40 and, as a result, the grid lines 36 will heat up via resistive heating. A portion of this current will also be conducted by the electrical conductive layer 42. Accordingly, at least the area between adjacent grid lines 36 will also be caused to heat up via resistive heating. This area is representatively illustrated by the dashed diagonal lines 44 of the conductive layer 42. In addition to heating up resistively, the conductive layer 42 may also be conductively heated via the heat generated by the grid lines 36. Thus, a portion of the heat generated by the grid lines 36 can be thermally conducted by the conductive layer 42 into the areas surrounding the grid lines 36 between adjacent grid lines 36. To facilitate this thermal conduction, the conductive layer 42 preferably has a thermal conductivity greater than plastics in general and, more specifically, polycarbonate, which has a thermal conductivity of $4.78\times10^{-4}$ cal/cm-sec-° C. By thermally conducting the heat of the grid lines 36 over the areas of the panel 34 between the grid lines 36 via the conductive layer 42, this heat is more readily applied to a greater area of the panel 34 than if the panel 34 alone had had to conduct the heat from the grid lines 36. As a result of the heating of the grid lines 36 and the conductive layer, ice, fog or frost on the surface of the panel 34 is melted or dissipated in the viewing area defined between the laterally outward-most grid lines 32.

The panel 34 may further include areas of opacity, such as a black out border 46 (see FIG. 2A). Such borders 46 are typically used for aesthetic reasons, such as masking fit and finish imperfections and concealing functional components such as mounting structures or the bus bars 38, 40 of the heater grid 35. The blackout border 46 can be applied to the panel 34 by printing an opaque ink onto the surface of the panel 34 or through the use of the known in mold decorating techniques, including insert film molding.

Figure 3A:
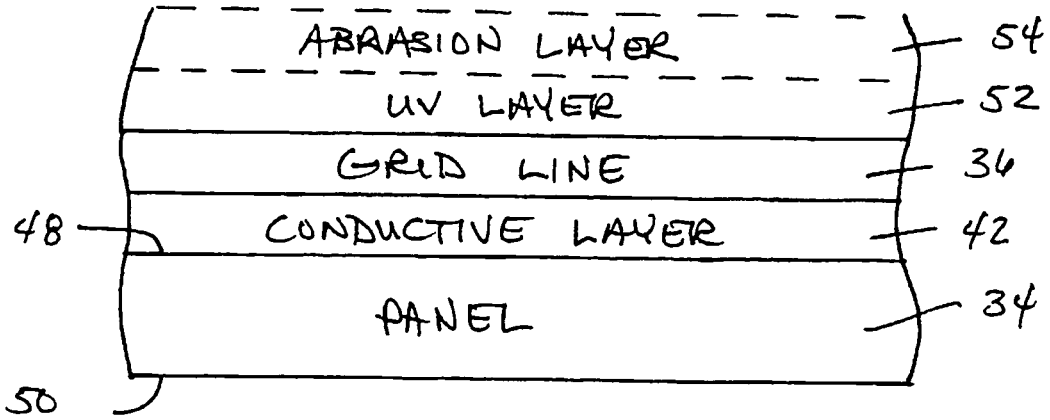
FIGS. 3A, 3B and 3C are diagrammatic illustrations of the layering of the present invention or a substrate without and with protective coatings, respectively, applied thereto.
Figure 3B:
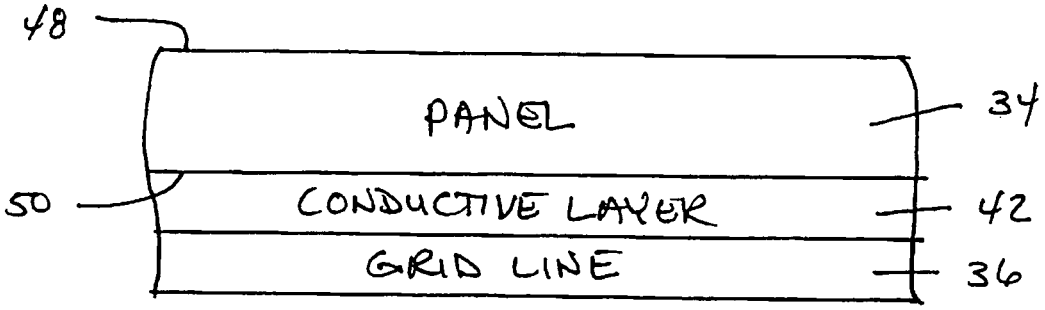
Figure 3C:
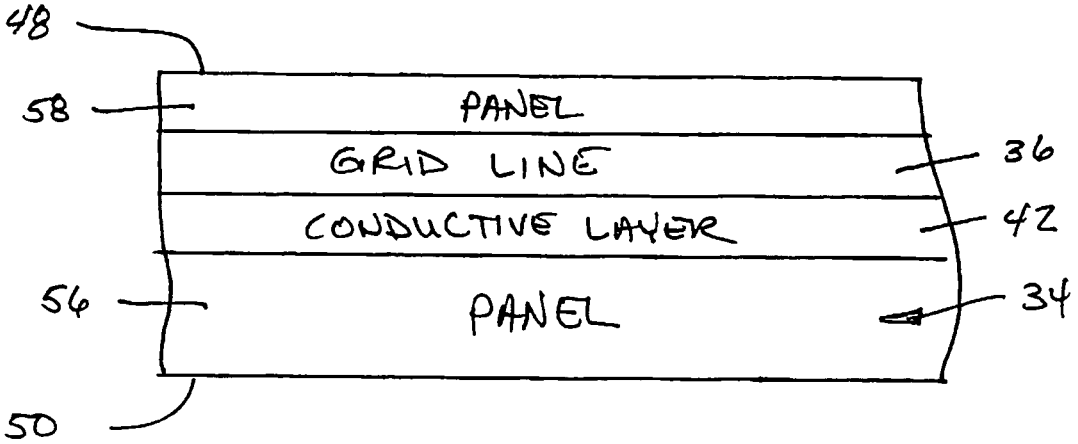

Referring now to FIGS. 3A, 3B and 3C, various alternative constructions for a window defroster assembly 30 embodying the principles of the present invention are illustrated therein. During implementation of the window defroster assembly 30 in a vehicle, opposed surfaces 48, 50 of the panel 34 would respectively define either a surface facing the exterior of the vehicle or a surface facing the interior of the vehicle. In the schematic illustrations of FIGS. 3A-3C, the exterior of the vehicle to be considered as towards the top of the page while the interior of the vehicle is to be considered as toward the bottom of the page.

As seen in FIG. 3A, the conductive layer 42 is applied directly to the exterior surface 48 of the panel 34 and the grid lines 36 of the heater grid 35 are applied on top of the conductive layer 42. Conversely in FIG. 3B, the conductive layer 42 is applied to the interior surface 50 of the panel 34. In the grid line 36 of the heater grid 35 is applied over the conductive layer. In its final construction, the panel 34 may be protected from various natural occurrences, such as exposure to ultraviolet radiation, oxidation and abrasion, through the use of a protective layer 52, or additional, optional protective layers 54. These protective layers 52, 54 may be provided on one or both of the exterior side and/or interior side of the panel 34. As the term is used herein, a transparent plastic panel 34 with at least one protective layer is defined as a transparent plastic glazing panel.

In the alternate construction shown in the schematic illustration of the FIG. 3C, the conductive layer 42 in grid line 36 are integrated within the panel 34 itself. In this construction, the panel 34 is formed of two layers, an inner panel layer 56 and outer panel layer 58, with the conductive layer 42 in the grid lines 36 provided there between.

The transparent plastic panel 34, itself may be constructed of any thermoplastic polymeric resin or a mixture or combination thereof. Appropriate thermoplastic resins include, but are not limited to, polycarbonate resins, acrylic resins, polyarylate resins, polyester resins, and polysulfone resins, as well as copolymers and mixtures thereof. The panel 34 to which the present invention is applied may be a vitreous oxide. Vitreous oxides suitable for use in the present invention include any type of glass, such as $SiO_2$, soda lime, aluminosilicate, $B_2O_3$—$P_2O_5$, $FE_{1-x}B_x$, $Na_2O$—$SiO_2$, $PbO_3$—$SiO_2$, $SiO_2$-$B_2O_3$, and $SiO_2$—$P_2O_5$. Transparent panels may be formed into a window through the use of any known technique to those skilled in the art, such as molding, thermoforming, or extrusion. The panels 34 may be formed into a window through the use of any of the various known techniques, such as molding, thermoforming, or extrusion. As noted previously, the panels 34 may further include areas of opacity applied by printing an opaque ink on the panel 34 in the form of a black-out border 46 or molding a border using an opaque resin.

The conductive layer 42 may be comprised of a conductive panel or sheet, coating, or film. For the conductive layer as a film, it is preferred that it be comprised of inorganic elements, such as indium, tin, tantalum, cadmium, or zinc among others. In addition to inorganic elements, the conductive film may comprise some organic elements, such as oxygen, or carbon among others. Some examples of conductive films include silver, indium tin oxide (ITO), zinc oxide doped indium oxide (IZO), and aluminum doped zinc oxide. As noted above, the conductive layer 42 has a thermal conductivity that preferably is greater than plastics, such as polycarbonate. For example, the thermal conductivity of indium tin oxide is about $2\times10^{-2}$ cal/cm-sec-° C. These conductive films may be deposited by any techniques known to those skilled in the art including but not limited to sputtering, physical vapor deposition, evaporation, and spray pyrolysis.

For the conductive layer 42, as a coating, it is preferred that it be comprised of conductive nanoparticles having a diameter less than about 100 nanometers Some examples of conductive nanoparticles include metals, such as silver, copper, zinc, aluminum, magnesium, nickel, tin, or mixtures and alloys of the like, as well as metal compounds and conductive organic polymers, such as polyaniline, amorphous carbon, and carbon-graphite. The conductive nanoparticles may be surface treated or dispersed with a polymeric matrix that will adhere to the transparent plastic panel. The conductive coating may be applied by any technique known to those skilled in the art including but not limited to atmospheric coating processes, such as curtain coating, spray coating, dip coating, flow coating, and spin coating. The use of nanoparticles are desired in order to maintain relative transparency of the plastic panel.

The heater grid 35 may be printed directly onto the inner surface 50 or outer surface 48 of the plastic panel 34. Alternatively, it may be printed on the surface of a protective layer 52, 54. In either construction, printing may be affected using a conductive ink or paste and any method known to those skilled in the art including, but not limited to, screen-printing, ink jet, or automatic dispensing. Automatic dispensing includes techniques known to those skilled in the art of adhesive application, such as drip & drag, streaming, and simple flow dispensing.

The heater grid 35 may be formed from any conductive material including conductive pastes, inks, paints, or films known to those skilled in the art. If the conductive element is a past, ink, or paint, it is preferred that they include conductive particles, flakes, or powders dispersed in a polymeric matrix. This polymeric matrix is preferably an epoxy resin, a polyester resin, a polyvinyl acetate resin, a polyvinylchloride resin, a polyurethane resin or mixtures and copolymers of the like.

The conductive particles, flakes or powders may be of a metal including, but not limited to, silver, copper, zinc, aluminum, magnesium, nickel, tin, or mixtures and alloys of the like, as well as any metallic compound, such as a metallic dichalcongenide. These conductive particles, flakes, or powders may also be any conductive organic material known to those skilled in the art, such as polyaniline, amorphous carbon, and carbon-graphite. Although the particle size of any particles, flakes, or powders may vary, a diameter of less than about 40 μm is preferred with a diameter of less than about 1 μm being specifically preferred. Any solvents, which act as the carrier medium in the conductive pastes, inks, or paints, may be a mixture of any organic vehicle that provides solubility for the organic resin. Examples of metallic pastes, inks, or paints include silver-filled compositions commercially available from DuPont Electronic Materials, Research Triangle Park, N.C. (5000 Membrane Switch, 5029 Conductor Composition, 5021 Silver Conductor, and 5096 Silver Conductor), Acheson Colloids, Port Huron, Mich. (PF-007 and Electrodag SP-405), Methode Engineering, Chicago, Ill. (31-1A Silver Composition, 31-3A Silver Composition), Creative Materials Inc., Tyngsboro, Mass. (118-029 2k Silver), and Advanced Conductive Materials, Atascadero, Calif. (PTF-12).

As previously mentioned, in its final construction, the plastic panel 34 may be protected from such natural occurrences as exposure to ultraviolet radiation, oxidation, and abrasion through the use of a single protective layer 52 or additional, optional protective layers 54.

The protective layers 52, 54 may be a plastic film, an organic coating, an inorganic coating, or a mixture thereof. The plastic film may be of the same or different composition as the transparent panel. The film and coatings may comprise ultraviolet absorber (UVA) molecules, rheology control additives, such as dispersants, surfactants, and transparent fillers (e.g., silica, aluminum oxide, etc.) to enhance abrasion resistance, as well as other additives to modify optical, chemical, or physical properties. Examples of organic coatings include, but are not limited to, urethanes, epoxides, and acrylates and mixtures or blends thereof. Some examples of inorganic coatings include silicones, aluminum oxide, barium fluoride, boron nitride, hafnium oxide, lanthanum fluoride, magnesium fluoride, magnesium oxide, scandium oxide, silicon monoxide, silicon dioxide, silicon nitride, silicon oxy-nitride, silicon oxy-carbide, silicon carbide, tantalum oxide, titanium oxide, tin oxide, indium tin oxide, yttrium oxide, zinc oxide, zinc selenide, zinc sulfide, zirconium oxide, zirconium titanate, or glass, and mixtures or blends thereof.

The protective coatings applied as protective layers 52, 54 may be applied by any suitable technique known to those skilled in the art. These techniques include deposition from reactive species, such as those employed in vacuum-assisted deposition processes, and atmospheric coating processes, such as those used to apply sol-gel coatings to substrates. Examples of vacuum-assisted deposition processes include but are not limited to plasma enhanced chemical vapor deposition, ion assisted plasma deposition, magnetron sputtering, electron beam evaporation, and ion beam sputtering. Examples of atmospheric coating processes include but are not limited to curtain coating, spray coating, spin coating, dip coating, and flow coating.

As an illustrative example, a polycarbonate panel 34 comprising the Exatec® 900 automotive window glazing system can be provided with a defroster 32 according to the present invention. In this particular case, a transparent polycarbonate panel 34 is protected with a multilayer coating system (Exatec® SHP-9X, Exatec® SHX, and a deposited layer of a "glass-like" coating ($SiO_xC_yH_z$) that is then coated with the conductive layer and printed with a heater grid 35 on the exposed surface of the protective layer facing the interior of the vehicle. As a further alternative construction, a heater grid may be placed on top of a layer or layers of a protective coating or coatings and then over-coated with an additional layer or layers of a protective coating or coatings. For instance, a heater grid may be placed on top of a silicone protective coating (e.g., AS4000, GE Silicones) and subsequently over-coated with a "glass-like" coating or film.

The enhanced performance of the present invention can be demonstrated by comparing the performance of three test window defroster assemblies designed to cover the same surface area of a plastic panel. As such, a simple test pattern was used to compare the ability of three different defroster assemblies to heat and melt ice according the SAE J953 defrosting protocol. The first of these three defroster assemblies included a simple three grid line heater grid with each grid line being about 1 mm wide and 250 mm in length, spaced about 50 mm apart in connecting two bus bars screen printed onto a polycarbonate surface using a conductive silver ink/paste. The second test assembly first coated the surface of a polycarbonate panel with a conductive layer of indium tin oxide, which has a sheet resistivity of about 20 ohms/square. (As used herein, the number of squares present in a grid line is calculated by dividing the measured length of the grid line by the measured width of the grid line.) The same three line heater grid was then screen printed onto the conductive layer. In the third test assembly, a polycarbonate substrate was coated with the same conductive layer as the second test assembly and only the bus bars of the previously described heater grid were screen printed onto the conductive layer. In other words, the third test assembly was formed without grid lines.

Each of the test window defroster assemblies were sprayed with the same amount of water and then subjected to a minus 20° C. temperature for several hours to equilibrate the surface temperature and establish a "frosted" condition on the assemblies. A total 7.45 volts was applied to each defroster assembly and the defrosting characteristics noted and measured for a test period of 20 minutes.

The first test assembly was found to defrost about 25% of the viewing area established between the grid lines of its heater grid. The third test assembly did not appreciably defrost during the 20 minutes allotted for the test. The second test assembly was found to defrost greater than about 50% of an area extending between each of the grid lines, plus one inch beyond the lateral most grid lines. Thus, a viewing area of about 250 mm by 150 mm (or 37,500 $mm^2$) was defrosted. This represents twice the amount of area defrosted by the first of the test assemblies. In view of the above test results, in can be concluded that the basic construction of the second test assembly and its operation, is superior to either of the other test constructions.

As mentioned above, the conductive layer carries a small amount of current and provides an amount of resistive heating to the surface area of the panel 34 in the areas between the grid lines 36 of the heater grid 35 and thereby raises the surface temperature of the panel in this area. In addition, since the conductive layer has a higher thermal conductivity than the plastic resin from which the panel 34 is constructed, the conductive layer 42 allows heat generated by the grid lines 36 to spread more quickly away from the grid lines 36 and into the adjacent areas. Thus, the electrical conductivity of the conductive layer, the thermal conductivity of the conductive layer and/or both contribute to a more efficient defrosting of a window defroster assembly embodying the principles of the present invention.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

What is claimed is:

1. A window defroster assembly comprising:

a transparent panel having a first side;

a defroster integrally formed with the panel, the defroster including a transparent conductive layer overlaying at least a portion of the panel on the first side; and a heater grid having first and second bus bars and a plurality of grid lines extending between and connected to the first and second bus bars, wherein the conductive layer is provided on the first side of the panel in an area between at least one adjacent pair of the grid lines, the conductive layer contacting and being electrically connected to the grid lines.

2. The window defroster assembly of claim 1 wherein the conductive layer covers substantially an entire surface of the panel.

3. The window defroster assembly of claim 1 wherein the conductive layer contacts the bus bars.

4. The window defroster assembly of claim 1 wherein the conductive layer is located between the heater grid and the panel.

5. The window defroster assembly of claim 1 wherein the conductive layer includes indium tin oxide (ITO).

6. The window defroster assembly of claim 1 wherein the conductive layer is electrically conductive.

7. The window defroster assembly of claim 1 wherein the conductive layer is thermally conductive and has a thermal conductivity greater than polycarbonate.

8. The window defroster assembly of claim 1 wherein the conductive layer includes aluminum doped zinc oxide.

9. The window defroster assembly of claim 1 wherein the conductive layer exhibits a sheet resistivity of less than about 20 ohm/square.

10. The window defroster assembly of claim 1 wherein the grid lines are laterally oriented with the assembly in the installed state.

11. A vehicle incorporating the defroster assembly of claim 1 the panel is a glass panel.

12. A vehicle incorporating the defroster assembly of claim 1 the panel is a plastic panel.

13. A vehicle incorporating the defroster assembly of claim 1 the panel is a polycarbonate panel.

14. The window assembly of claim 1 wherein a distance between adjacent grid lines is greater than about 25 mm.

15. The window assembly of claim 1 wherein the conductive layer includes inorganic elements selected from the group of indium, tin, and zinc.

16. The window assembly of claim 1 wherein the conductive layer includes inorganic elements that are mixed with oxygen, carbon, or combinations thereof.

17. The window assembly of claim 1 wherein the panel is formed of a material selected from the group of polycarbonate resins, acrylic resins, polyarylate resins, polyester resins, or polysulfone resins, copolymers and mixtures thereof.

18. A window assembly of claim 1 further comprising at least one protective coating applied over the transparent panel to enhance weather and abrasion resistance.

19. The window assembly of claim 18 wherein the protective coating comprises a plurality of protective layers.

20. The window assembly of claim 19 wherein the protective layers are selected from the group of an acrylic primer, a silicone interlayer and a polyurethane interlayer over-coated with a "glass-like" topcoat.

21. The window assembly of claim 20 wherein the heater grid is on top of the protective coating.

22. The window assembly of claim 20 wherein the heater grid is between layers of the protective coatings.

23. The window assembly of claim 1 wherein the heater grid is located under a second transparent panel that is integral with the first transparent panel.

24. The window assembly of claim 1 wherein the conductive layer includes nanoparticles selected from the group of metals, metal compounds, or conductive organic polymers.

25. The window assembly of claim 24 wherein the metals are selected from the group of silver, copper, zinc, aluminum, magnesium, nickel, tin, and alloys thereof.

* * * * *